US007849523B2

(12) United States Patent
Crittenden et al.

(10) Patent No.: US 7,849,523 B2
(45) Date of Patent: Dec. 14, 2010

(54) DETACHABLE PANT STIRRUPS

(76) Inventors: Jennifer Crittenden, 801 S. Greenbriar St., #403, Arlington, VA (US) 22204; Lisa Church, 5906 Mayflower Ct., Alexandria, VA (US) 22312

( * ) Notice: Subject to any disclaimer, the term of this patent is extended or adjusted under 35 U.S.C. 154(b) by 76 days.

(21) Appl. No.: 12/050,302

(22) Filed: Mar. 18, 2008

(65) Prior Publication Data

US 2009/0235432 A1 Sep. 24, 2009

(51) Int. Cl.
*A41D 1/06* (2006.01)

(52) U.S. Cl. ..... 2/232

(58) Field of Classification Search ..... 2/79, 2/227, 238, 242, 239, 232, 240
See application file for complete search history.

(56) References Cited

U.S. PATENT DOCUMENTS 1,142,201 A * 6/1915 Peterson ..... 2/404
1,226,208 A * 5/1917 Handschuck ..... 2/240
2,638,602 A * 5/1953 Binkowitz ..... 2/240
4,115,906 A * 9/1978 Lavine et al. ..... 24/72.1
4,393,522 A * 7/1983 Calabrese ..... 2/336
5,214,805 A * 6/1993 Cochran ..... 2/232
5,542,156 A * 8/1996 Oglesby ..... 24/72.1

* cited by examiner

*Primary Examiner*—Tejash Patel
(74) *Attorney, Agent, or Firm*—Merek, Blackman & Voorhees, LLC

(57) ABSTRACT

A stirrup for securing the end of a pant leg to the foot of a wearer. The stirrup has a base web and at least three arms projecting therefrom. Each arm has a fastener such as alligator jaws style, for engaging the pant leg at at least three points about its circumference, to avoid bunching. The base member may comprise an elastic fabric and may include a length adjusting mechanism. Alligator jaw fasteners may instead comprise buttons, hooks, hook and loop material, or snaps. The stirrup may be made from denim, leather, cotton, satin, lace, or nylon. The base web may optionally form a sock.

20 Claims, 3 Drawing Sheets

DETACHABLE PANT STIRRUPS

BACKGROUND OF THE INVENTION

1. Field of the Invention

The present invention relates to accessories for clothing, and more particularly to a device for preventing bunching of pant legs that have been inserted into footwear.

2. Background of the Invention

It is frequently found convenient to wear pants with the ends of the legs inserted into shoes, boots or other footwear. Tucking the pants into footware protects the ends of the pants from exposure to moisture in wet environments, protects the ankle of the wearer from drafts in cold environments, may provide a fashion effect, and may provide other benefits.

However, the fabric of the pant legs have a tendency to become bunched when worn in this fashion. Bunching may cause discomfort, may wrinkle the pant fabric, may fail to provide warmth or coverage of the ankle, or may present other problems.

While stirrups and other attachments for addressing this problem are known; they do not fully solve the problem. One characteristic of known attachments is that they each engage the pant leg at only two points. Typically, the two points are at diametrically opposed points of the leg. While this arrangement exerts some control over the pant leg, a desirable degree of control is often not achieved.

There continues to exist a need in the field of pant leg retainers to overcome the above noted problems.

SUMMARY OF THE INVENTION

The present invention sets forth a pant leg securing device which addresses the above noted problems. The pant leg securing device comprises a strap arrangement which engages the pants at several points about the circumference of pant legs, and encircles the foot, thereby securing the pant leg by anchoring the same to the foot.

The pant leg securing device engages the pant leg at more than two points, thereby increasing control of the pant leg securing device over bunching and other problems.

The pant leg securing device is detachable from the pants, and is thus transferable to different garments.

In one aspect of the invention, the pant leg securing device may include adjustment features enabling the pant leg securing device to accommodate different pants and different physiological dimensions and configurations. Illustratively, at least part of the length of the strap arrangement may be made from a stretchable, elastic material. In another example, the strap arrangement may incorporate a length adjustment mechanism. It is contemplated that a single model or size of a pant leg securing device will successfully serve a high percentage of potential users, so that the number of different models or sizes required to serve almost all potential wearers is minimized.

It is an object of the invention to improve pant leg securing devices to enhance control over pant legs engaged by the former.

It is another object of the invention to accommodate a greater range of physiological dimensions and configurations by one pant leg securing device than is presently served by any one similar device.

It is an object of the invention to provide improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
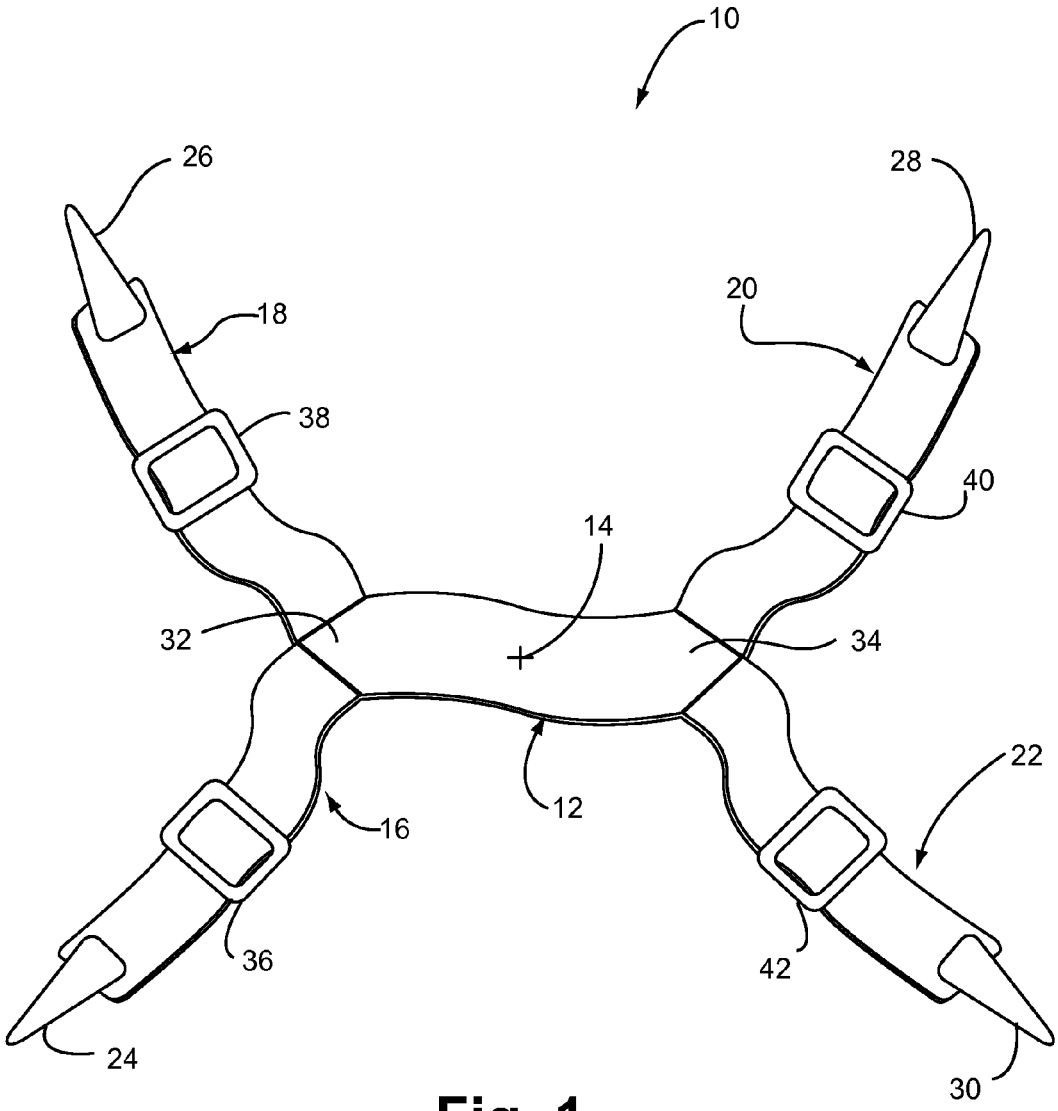
FIG. 1 is a plan view of a pant leg securing device according to one aspect of the invention.

FIG. 1 shows a detachable stirrup or pant leg securing device 10 for anchoring a pant leg (not shown) of a wearer of pants to the foot of the wearer, according to one aspect of the invention. The pant leg securing device 10 will be seen to comprise a first web 12 for spanning the sole of the foot of the wearer, wherein the first web 12 has a center point 14, taken between the right and left sides of the foot when a wearer dons the pant leg securing device 10, and a plurality of second webs 16, 18, 20, 22. Each one if the second webs 16, 18, 20, 22 projects outwardly from the first web 12, or alternatively stated, projects away from the center point 14, and bears a respective fastener 24, 26, 28, 30 for engaging the fabric of the pant leg at the circumference of the pant leg. The fasteners 24, 26, 28, 30 may be for example, spring loaded alligator jaw assemblies.

Figure 2:
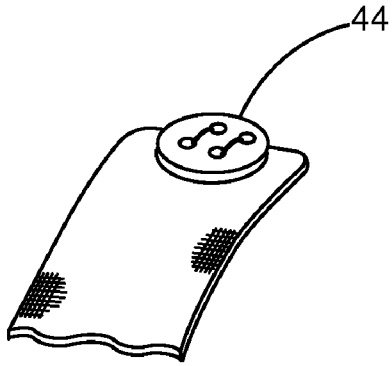
FIG. 2 is a perspective detail view of a button fastener as an alternative to the alligator jaw assemblies of FIG. 1.
Figure 3:
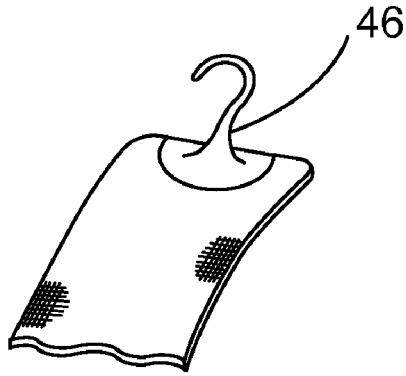
FIG. 3 is a perspective detail view of a hook fastener as an alternate to the alligator jaw assemblies of FIG. 1.
Figure 4:
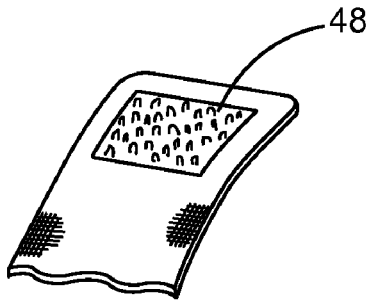
FIG. 4 is a perspective detail view of hook and loop fastening material as an alternative to the alligator jaw assemblies of FIG. 1.
Figure 5:
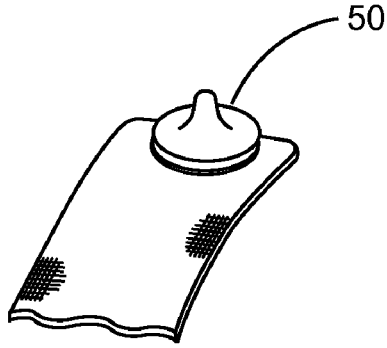
FIG. 5 is a perspective detail view of a snap fastener as an alternative to the alligator jaw assemblies of FIG. 1.

According to other aspects of the invention, other suitable fasteners may include buttons 44 (see FIG. 2), hooks 46 (see FIG. 3), hook and loop fastening material 48 (see FIG. 4), and snap fasteners 50 (see FIG. 5). Four second webs 16, 18, 20, 22 are depicted in the example of FIG. 1. However, the number of second webs may be as few as three or more than four, if desired. It is contemplated that at least three points of attachment to a pant leg will anchor the pant leg in a stable manner.

The first web 12 has length aligned in the side to side direction relative to the foot of the wearer. That is, the end 32 and the opposed corresponding end 34, which are located along and separated by the length of the web 12, would be located on the right and left sides of the foot of the wearer. Each one of the second webs 16, 18, 20, 22 projects from one of the first and second opposed ends 32, 34 of the web 12.

The first web 12 preferably comprises a stretchable, elastic material spanning at least part of the length thereof. Each one of the second webs 16, 18, 20, 22, being more prone to be visible when the pant leg securing device 10 is worn, is preferably fabricated from a constituent material selected from the group including denim, leather, cotton, satin, lace, and nylon. As these materials are not elastic, each of the second webs 16, 18, 20, 22 bears a length adjustment mechanism such as a buckle or slide 36, 38, 40, 42 to enable a snug, comfortable fit when the pant leg securing device 10 is worn. The length adjustment mechanism is of any type which is operable to vary length of its respective second web 16, 18, 20, or 22 without the respective second web being under undue tension. Alternatively, a portion of each second web could be elastic and a portion fabricated from the constituent material above to provide adjustability, while preserving the cosmetic effect of the decorative material. This is especially useful when the decorative material cannot easily be used in the strap adjustment device, etc.

Figure 6:
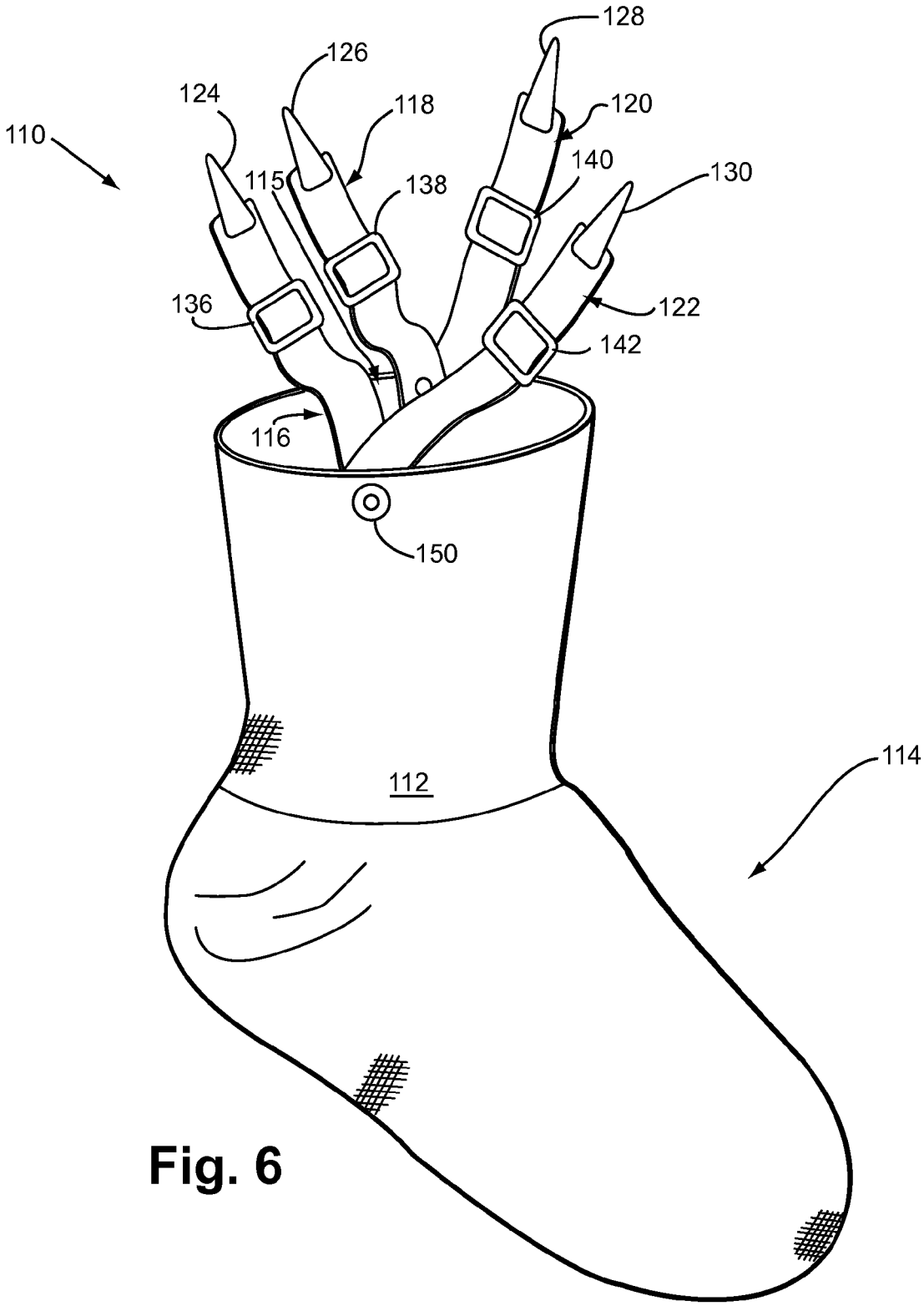
FIG. 6 is a perspective view of another pant leg securing device according to a second aspect of the invention.

Turning now to FIG. 6, a pant leg securing device 110 according to another aspect of the invention forms a sock which is dimensioned and configured to at least partially envelop the foot of the wearer. The pant leg securing device 110 comprises a first web in the form of a tube 112 which spans the sole of the foot of the wearer, and has a closed end 114 for covering the toe of the wearer and an open second end 115 for inserting the foot into the tube 112. There are at least three second webs, four second webs 116, 118, 120, 122 being depicted in FIG. 2. Each one of the second webs 116, 118, 120, 122 is attached to and projects from the first web or tube 112 at the open end 115 of the tube 112.

The second webs 116, 118, 120, 122 may be provided in pairs joined to one another at their respective points of attachment to the first web or tube 112, each pair of the second webs (e.g., 116, 122 or 118, 120) thereby assuming a V-shaped configuration. Attachment of the second webs 116, 122 may be provided by a single fastener such as a rivet 150 located where the second webs 116, 122 overlie the fabric of the tube 112.

The pant leg securing device 10 and the pant leg securing device 110 may have any of the features of either where feasible. Illustratively, each one of the second webs 116, 118, 120, 122 may have a respective length adjusting mechanism 136, 138, 140, 142 of nature comparable to those of the second webs 16, 18, 20, 22. Also, the second webs 116, 118, 120, 122 may have respective fasteners 124, 126, 128, 130, which may be for example, of the spring loaded alligator jaw assembly type, of the button type, of the hook type, of the hook and loop material type, or of the snap fastener type.

We claim:

1. A pant leg stirrup for anchoring a pant leg of a wearer of pants to the foot of the wearer, comprising:

a first web strap on the stirrup for spanning the sole of the foot of the wearer, wherein the first web has a center point; and at least three second webs each projecting from the first web, wherein each one of the at least three second webs bears a respective fastener for selectively, releasably engaging the fabric of the pant leg at the circumference of the pant leg, and wherein each one of the at least three second webs projects away from the center point of the first web.

2. A pant leg securing device according to claim 1, wherein the first web has an elongated length aligned in the side to side direction relative to the foot of the wearer, and first and second ends mutually opposed and separated by the length of the first web, and wherein each one of said at least three second webs projects from one of the first and second opposed ends of the first web.

3. A pant leg securing device according to claim 1, wherein the first web comprises an elongated stretchable, elastic material spanning at least part of the length of the first web.

4. A pant leg securing device for anchoring a pant leg of a wearer of pants to the foot of the wearer, comprising:

a first web for spanning the sole of the foot of the wearer, wherein the first web has a center point;

at least three second webs each projecting from the first web, wherein each one of the at least three second webs bears a respective fastener for engaging the fabric of the pant leg at the circumference of the pant leg, and wherein each one of the at least three second webs projects away from the center point of the first web, and wherein at least one of the second webs has a length adjustment mechanism disposed therein, wherein the length adjustment mechanism is operable to vary length of its respective second web without the respective second web being under tension.

5. A pant leg securing device according to claim 1, wherein the second webs are four in number, there being two said second webs located at and projecting from the first end of the first web and there being two said second webs located at and projecting from the second end of the first web.

6. A pant leg securing device according to claim 1, wherein each said fastener for engaging the fabric of the pant leg at the circumference of the pant leg comprises an alligator jaw assembly.

7. A pant leg securing device according to claim 1, wherein each said fastener for engaging the fabric of the pant leg at the circumference of the pant leg comprises a button.

8. A pant leg securing device according to claim 1, wherein each said fastener for engaging the fabric of the pant leg at the circumference of the pant leg comprises a hook.

9. A pant leg securing device according to claim 1, wherein each said fastener for engaging the fabric of the pant leg at the circumference of the pant leg comprises hook and loop fastening material.

10. A pant leg securing device according to claim 1, wherein each said fastener for engaging the fabric of the pant leg at the circumference of the pant leg comprises a snap fastener.

11. A pant leg securing device according to claim 1, wherein the second webs are fabricated from a constituent material selected from the group including denim, leather, cotton, satin, lace, and nylon.

12. A pant leg securing device for anchoring a pant leg of a wearer of pants to the foot of the wearer, comprising:

a first web for spanning the sole of the foot of the wearer, wherein the first web has a center point;

four second webs each projecting from the first web, wherein each one of the four second webs bears a respective fastener for engaging the fabric of the pant leg at the circumference of the pant leg, and wherein each one of the four second webs projects away from the center point of the first web, and wherein one pair of the four second webs are joined to and extend from a first end of the first web a V-shaped configuration, and a remaining pair of the four second webs are joined to and extend from an opposite end of the first web from said first end of the first web to form a second V shape configuration.

13. The pant leg securing device according to claim 12, wherein the point of attachment of each pair of second webs to the first web is reinforced by a permanently deformed metallic fastener.

14. A pant leg securing device for anchoring a pant leg of a wearer of pants to the foot of the wearer, consisting of:

an elongated first strap for spanning the sole of the foot of the wearer, wherein the first strap has a center point; and four second straps each projecting from the first strap, wherein each one of the four second straps bears a respective fastener for selectively engaging the fabric of the pant leg at the circumference of the pant leg, and wherein each one of the four second straps projects away from the center point of the first strap.

15. A method of anchoring a pant leg of a wearer of pants to the foot of the wearer within an article of footwear, comprising:

providing a first strap for spanning the sole of the foot of the wearer, wherein the first strap has a center point;

providing four second straps divided into a first pair of second straps and a second pair of second straps, wherein the first and the second pair of second straps are attached to opposite ends of the first strap, and wherein each of the four second straps bears a respective releasable fastener for selectively engaging the fabric of the pant leg at the circumference of the pant leg, and wherein each of the first and second pairs of second straps projects away from the center point of the first strap;

attaching said first pair of second straps releasable fasteners on a first side of a leg opening defined on the wearer's pant legs; and attaching said second pair of second straps releasable fasteners on a second side of the leg opening on the wearer's pant legs remote from said first side of the leg opening, securing the first strap in place underneath the sole of the foot of the wearer.

16. The method of claim 15, further comprising:

inserting the pants leg opening and the first strap and the four second straps in a footwear interior defined within walls of the article of footwear whereby the first strap and the four second straps retain the leg opening inside the footwear interior.

17. The method of claim 15, further comprising:

inserting the pants leg opening and the first strap and at least a portion of each of the four second straps into a footwear interior defined within walls of the article of footwear whereby the first strap and the at least four second straps retain the leg opening inside the footwear interior.

18. The method of claim 15, wherein each releasable fastener is a clip that can be disengaged and re-engaged a plurality of times from the pant fabric.

19. The method of claim 15, wherein each releasable fastener is a clip that is retained on the pant fabric by the force of jaws of the clips on the pant fabric.

20. The method of claim 15, wherein said first pair of second straps is attached to project in a V pattern away from a first end of the first strap and said second pair of second straps is attached to project in a V pattern away from an end of the first strap opposite said first end; and the first strap is arranged to end below an ankle bone of the wearer and each said first pair of second straps is clipped to the first side of the pant leg opening to form a V pattern around the ankle bone of the wearer and said second pair of second straps is clipped to the second side of the pant leg opening to form a V pattern around the ankle bone of the wearer to stabilize the first strap on the foot of the wearer.

* * * * *